US005823613A

United States Patent [19]

Yi

[11] Patent Number: 5,823,613

[45] Date of Patent: Oct. 20, 1998

[54] CIRCULAR WALKER

[76] Inventor: Chen Chin Yi, 56, Min Sheng Street, Fengyuan, Taichung, Taiwan

[21] Appl. No.: 877,699

[22] Filed: Jun. 17, 1997

[51] Int. Cl.[6] ..... A47D 13/04

[52] U.S. Cl. ..... 297/5; 297/6; 482/68

[58] Field of Search ..... 135/67; 297/5–7; 482/66, 68

[56] References Cited

U.S. PATENT DOCUMENTS

| | | | |
|---|---|---|---|
| 2,606,593 | 8/1952 | Beurskens | 297/5 X |
| 2,657,735 | 11/1953 | Hughes | 297/5 |
| 2,850,075 | 9/1958 | Wilson | 297/6 X |
| 3,788,695 | 1/1974 | Salem | 297/5 X |
| 4,822,030 | 4/1989 | Cone | 297/5 X |
| 5,040,556 | 8/1991 | Raines | 297/6 X |
| 5,688,211 | 11/1997 | Myers | 297/5 X |

*Primary Examiner*—Lanna Mai

[57] ABSTRACT

A circular walker has a base seat, a plurality of support legs, and an annular holder. The base seat has a disk plate, an annular wall surrounding the disk plate, an annular flange formed on the annular wall, an annular slide rail formed in the base seat, and a plurality of annular positioning plates disposed on the disk plate. Each of the annular positioning plates defines a recess hole to receive a ball. The annular holder has a ring and a band connected to the ring. The plurality of support legs are connected to the ring and disposed beneath the ring. Each of the support legs has an annular recess to receive the annular flange, a hollow taper end to receive a bearing and a spherical body. The spherical body is inserted in the annular slide rail.

2 Claims, 4 Drawing Sheets

CIRCULAR WALKER

BACKGROUND OF THE INVENTION

This invention relates to a circular walker, and more particularly to a safe circular walker.

A traditional circular walker has a plurality of casters. However, a baby may walk to a dangerous place. The traditional circular walker may bump an article and the article may fall down to hurt the baby.

SUMMARY OF THE INVENTION

An object of this invention is to provide a circular walker which will not move from an original place while a baby is walking in the circular walker.

Another object of this invention is to provide a circular walker which is safe while a baby is walking in the circular walker.

Yet another object of this invention is to provide an annular holder which can be rotated in a circular walker.

DETAILED DESCRIPTION OF THE INVENTION

Figure 1:
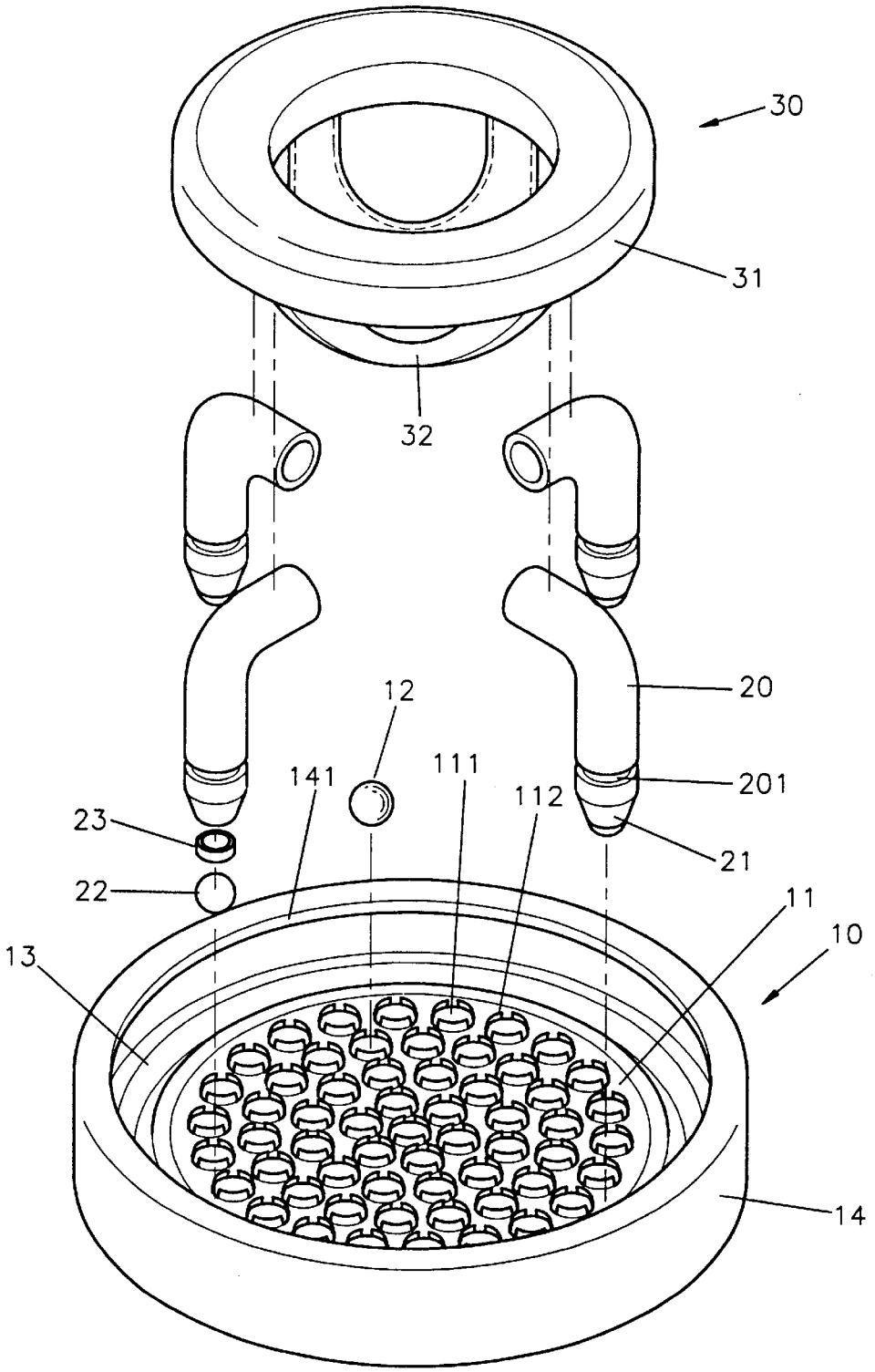
FIG. 1 is a perspective exploded view of a circular walker of a preferred embodiment.
Figure 2:
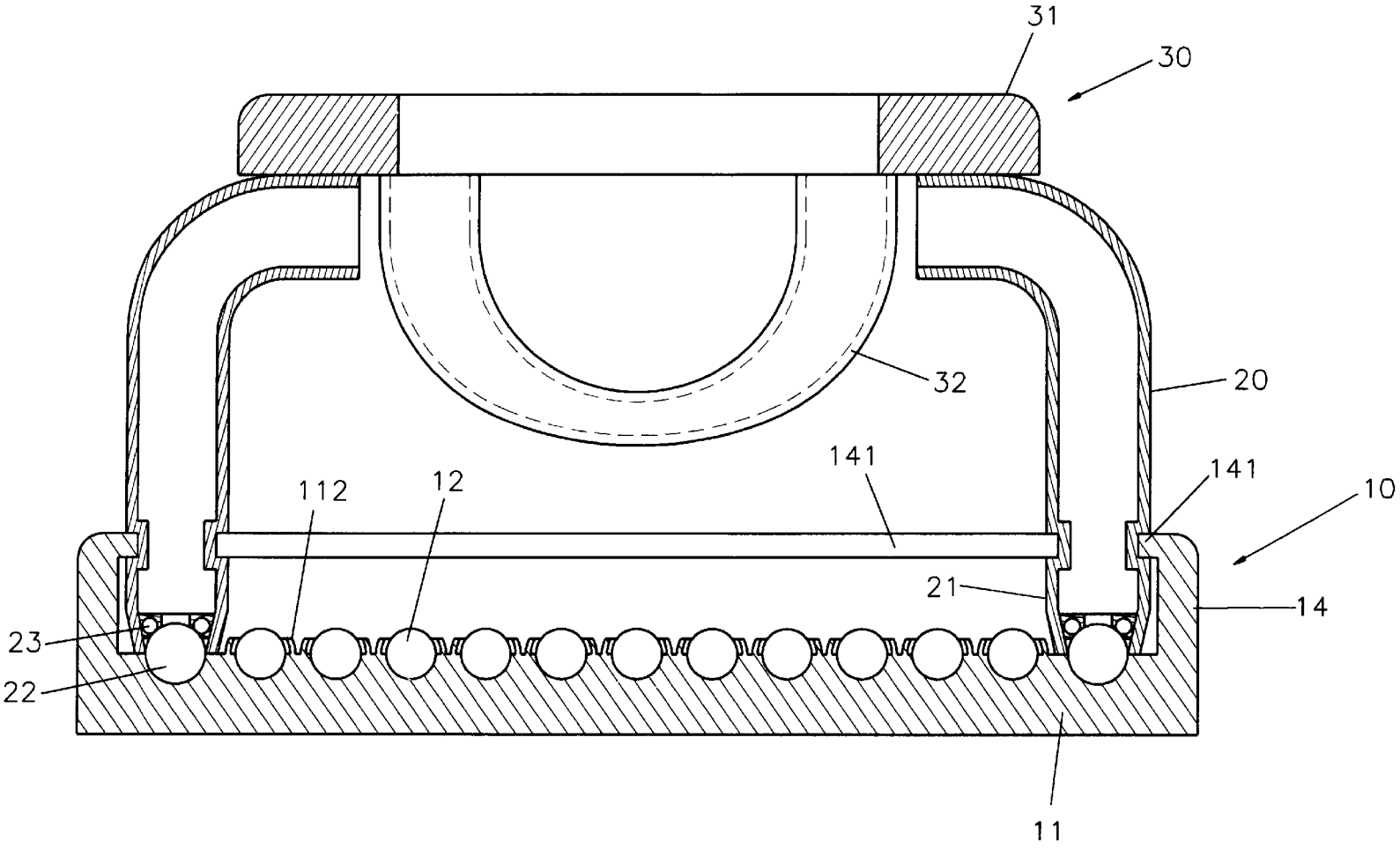
FIG. 2 is a sectional assembly view of a circular walker of a preferred embodiment.
Figure 4:
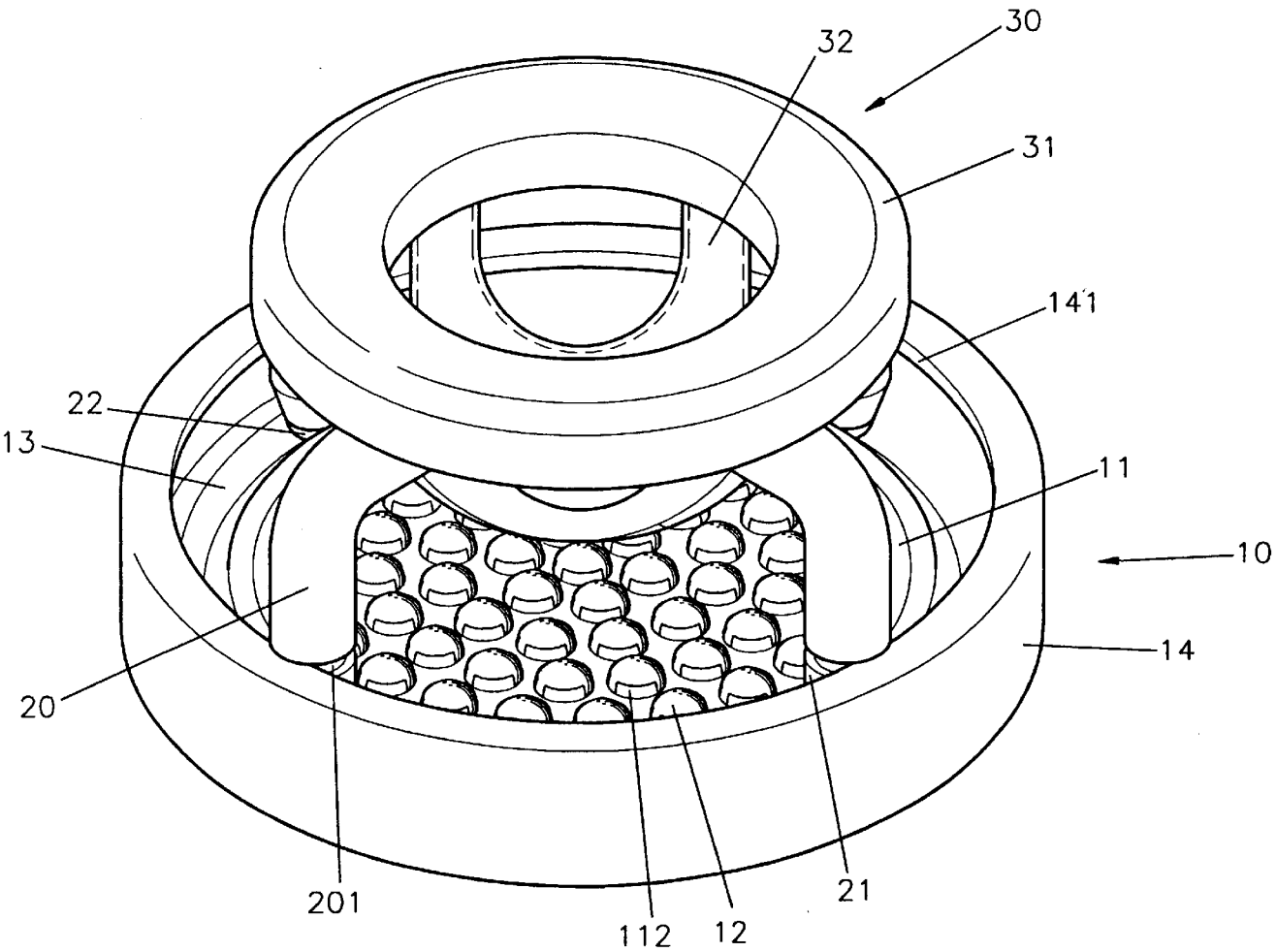
FIG. 4 is a perspective assembly view of a circular walker of a preferred embodiment.

Referring to FIGS. 1, 2 and 4, a circular walker comprises a base seat 10, a plurality of support legs 20, and an annular holder 30. The base seat 10 has a disk plate 11, an annular wall 14 surrounding the disk plate 11, an annular flange 141 formed on the annular wall 14, an annular slide rail 13 formed in the base seat 10, and a plurality of annular positioning plates 112 disposed on the disk plate 11. Each of the annular positioning plates 112 has three sections. Each of the annular positioning plates 112 defines a recess hole 111 to receive a ball 12. The ball 12 can be rotated in the respective recess hole 111. The annular holder 30 has a ring 31 and a band 32 connected to the ring 31. The plurality of support legs 20 are connected to the ring 31 and disposed beneath the ring 31. Each of the support legs 20 has an annular recess 201 to receive the annular flange 141, a hollow taper end 21 to receive a bearing 23 and a spherical body 22. The spherical body 22 is inserted in the annular slide rail 13.

Figure 3:
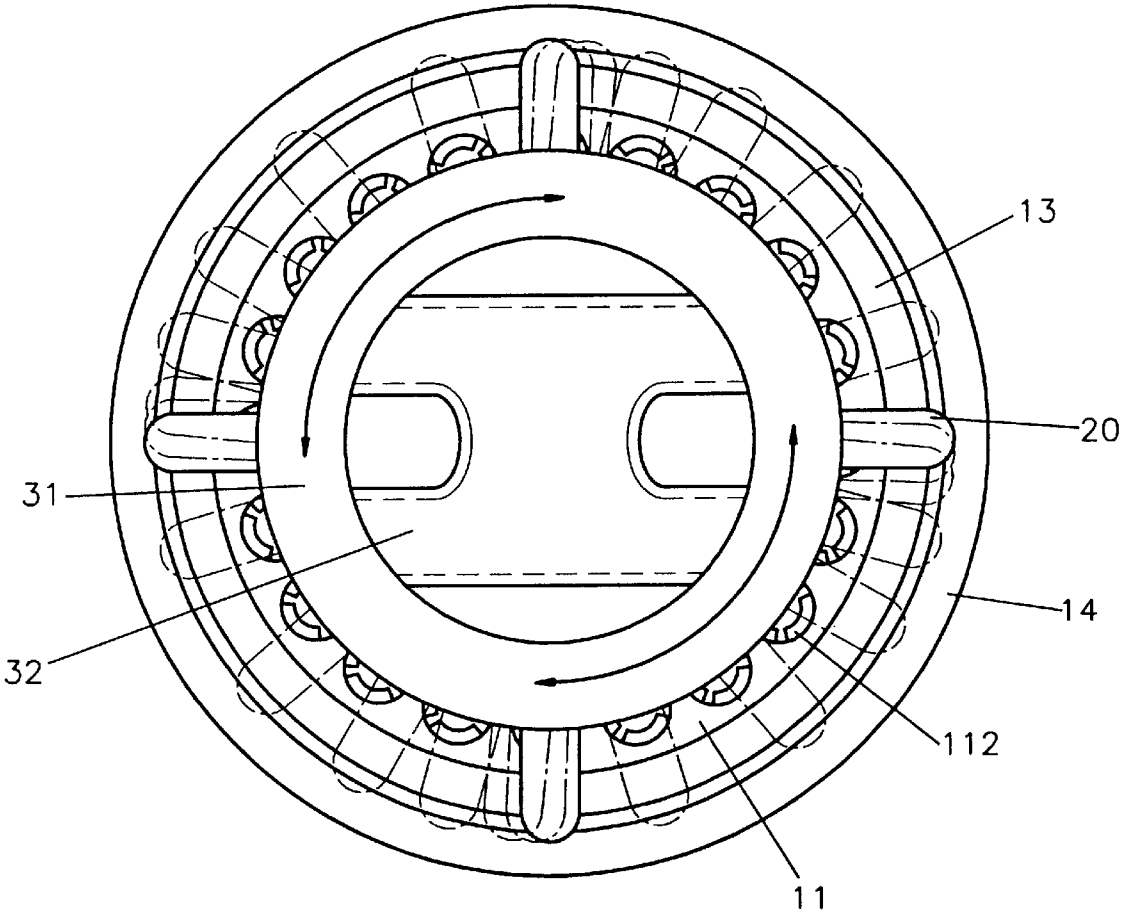
FIG. 3 is a top plan view illustrating a rotation of an annular holder in a circular walker.

Referring to FIGS. 2 to 4, the annular holder can be rotated in the circular walker while each of the spherical body 22 moves along the annular slide rail 13. The circular walker will not move from an original place while a baby is walking in the circular walker. Therefore, the circular walker is safe while a baby is walking in the circular walker.

Since the circular walker of this invention can protect the baby from bumping an article or moving toward a dangerous place, a baby sitter need not watch the baby very often while the baby is walking in the circular walker.

I claim:

1. A circular walker comprises:

a base seat having a disk plate, an annular wall surrounding the disk plate, an annular flange formed on the annular wall, an annular slide rail formed in the base seat, and a plurality of annular positioning plates disposed on the disk plate, each of the annular positioning plates defining a recess hole to receive a ball, an annular holder having a ring and a band connected to the ring, a plurality of support legs connected to the ring and disposed beneath the ring, each of the support legs having an annular recess to receive the annular flange, a hollow taper end to receive a bearing and a spherical body, and the spherical body inserted in the annular slide rail.

2. A circular walker as claimed in claim 1, wherein each of the annular positioning plates has three sections.

* * * * *